US009234700B1

(12) United States Patent
Gaur et al.

(10) Patent No.: US 9,234,700 B1
(45) Date of Patent: Jan. 12, 2016

(54) TUNNEL OVEN AIR LEAKAGE CONTROLLER, SYSTEM AND METHOD

(71) Applicant: Carbonyx, Inc., Plano, TX (US)

(72) Inventors: Siddhartha Gaur, Plano, TX (US); Vibha Bansal, Plano, TX (US); Travis Day, Ardmore, OK (US); Pablo Palomo, Allen, TX (US); Albert Montgomery, Houston, TX (US); Billy Joe Metker, Lindsay, OK (US); Michael Flagler, Dallas, TX (US); John Greg Bush, Duncanville, TX (US)

(73) Assignee: Carbonyx, Inc., Plano, TX (US)

( * ) Notice: Subject to any disclaimer, the term of this patent is extended or adjusted under 35 U.S.C. 154(b) by 117 days.

(21) Appl. No.: 14/213,820

(22) Filed: Mar. 14, 2014

Related U.S. Application Data

(60) Provisional application No. 61/852,395, filed on Mar. 15, 2013.

(51) Int. Cl.
*F26B 21/06* (2006.01)
*F26B 21/12* (2006.01)

(52) U.S. Cl.
CPC ..... *F26B 21/12* (2013.01)

(58) Field of Classification Search
CPC ..... F26B 3/00; F26B 5/00; F26B 11/00; F26B 21/00; F26B 21/06; F24J 3/00; F24J 3/08; B01D 37/00; B01D 37/02; C10B 1/00; C10B 1/10; F27D 15/00; F27D 15/02; F27D 9/00
USPC ..... 34/371, 491, 497, 498, 201, 203, 218, 34/239; 165/45, 186; 210/680, 282, 502.1; 201/33, 44; 432/11, 121
See application file for complete search history.

(56) References Cited

U.S. PATENT DOCUMENTS

| | | | | | |
|---|---|---|---|---|---|
| 3,787,171 | A * | 1/1974 | Cromp | F26B 23/022 | 432/59 |
| 4,856,202 | A * | 8/1989 | Radomsky | E01C 19/05 | 34/371 |
| 4,957,434 | A * | 9/1990 | Radomsky | E01C 19/1004 | 110/220 |
| 7,150,627 | B2 * | 12/2006 | Gaur | F27B 9/047 | 432/128 |
| 2006/0225770 | A1 * | 10/2006 | Nowack | B44D 3/166 | 134/19 |
| 2011/0318698 | A1 * | 12/2011 | Gaur | F27B 9/045 | 432/11 |
| 2012/0067987 | A1 * | 3/2012 | Garcia Sanz | F26B 3/205 | 241/22 |
| 2012/0231402 | A1 * | 9/2012 | Casson | F23D 14/18 | 431/328 |
| 2014/0083836 | A1 * | 3/2014 | Quanci | C10B 15/02 | 201/37 |
| 2014/0202028 | A1 * | 7/2014 | De Santos Avila | F26B 21/14 | 34/444 |

FOREIGN PATENT DOCUMENTS

| | | | | |
|---|---|---|---|---|
| DE | 19963736 A1 * | 7/2001 | | F27B 9/3005 |
| GB | 870730 A * | 6/1961 | | C04B 35/532 |
| JP | 2009084142 * | 4/2009 | | |
| WO | WO 8202475 A1 * | 8/1982 | | A21B 1/48 |

* cited by examiner

*Primary Examiner* — Stephen M Gravini
(74) *Attorney, Agent, or Firm* — Osha Liang LLP; John W. Montgomery

(57) ABSTRACT

In this invention, air leakage controls, method of controlling air leakage, and system for controlling air leakage in an industrial tunnel oven for use in an industrial tunnel oven and process for heating products conveyed along the tunnel oven.

10 Claims, 4 Drawing Sheets

TUNNEL OVEN AIR LEAKAGE CONTROLLER, SYSTEM AND METHOD

CROSS-REFERENCE TO RELATED APPLICATION

This application claims the benefit of U.S. Provisional Application 61/852,395 filed on Mar. 15, 2013.

BACKGROUND OF INVENTION

1. Field of the Invention

This invention relates generally to an industrial tunnel oven and process for heating products conveyed along the tunnel oven.

2. Background Art

Prior art tunnel ovens have been designed primarily for heating an inert product over a period of time as the product is conveyed along the tunnel oven wherein the temperature is controlled by adjusting the amount of heat added by gas burners or by electrical heating coils and the air leakage control does not adversely effect the control of the heating along the tunnel oven.

SUMMARY OF INVENTION

According to one or more embodiments, the invention comprises an air leakage controller for a tunnel oven of the type for processing a product fueled, exothermic reaction having a reaction temperature profile with a low temperature at a product entrance and increasing to a first desired higher temperature at a first distance into the tunnel oven, and a desired temperature profile progressing along the length of the tunnel oven, wherein the desired temperature profile includes at least one relative high temperature and at least one relative low temperature, the air leakage controller comprising: an air injection conduit having an inlet positioned in the tunnel oven at a position corresponding to the position along the temperature profile in the tunnel oven at which the at least one relative high temperature occurs, so that a positive pressure is maintained in the tunnel oven to thereby prevent additional air entry into the tunnel oven at other locations, and so that the component of oxygen in the air injected by the air injection conduit is depleted by the exothermic reaction of the product in the tunnel oven before the injected air flows from the relative high temperature location to the at least one relative low temperature location along the temperature profile of the tunnel oven; and an air injection pressure control for adjusting the amount of air injected to maintain the positive pressure and to provide a volume of air for providing a component of oxygen adequate for maintaining the exothermic reaction at or below the relatively high temperature without exceeding the desired relatively low temperature.

According to one or more embodiments, the oven cooling water is captured in a cleaning tank. Heat energy from cooling the heated content of the oven is thereby used to preheat purified water in the closed system steam turbine for driving the electric generator.

Other aspects and advantages of the invention will be apparent from the following description and the appended claims.

DETAILED DESCRIPTION

Figure 1:
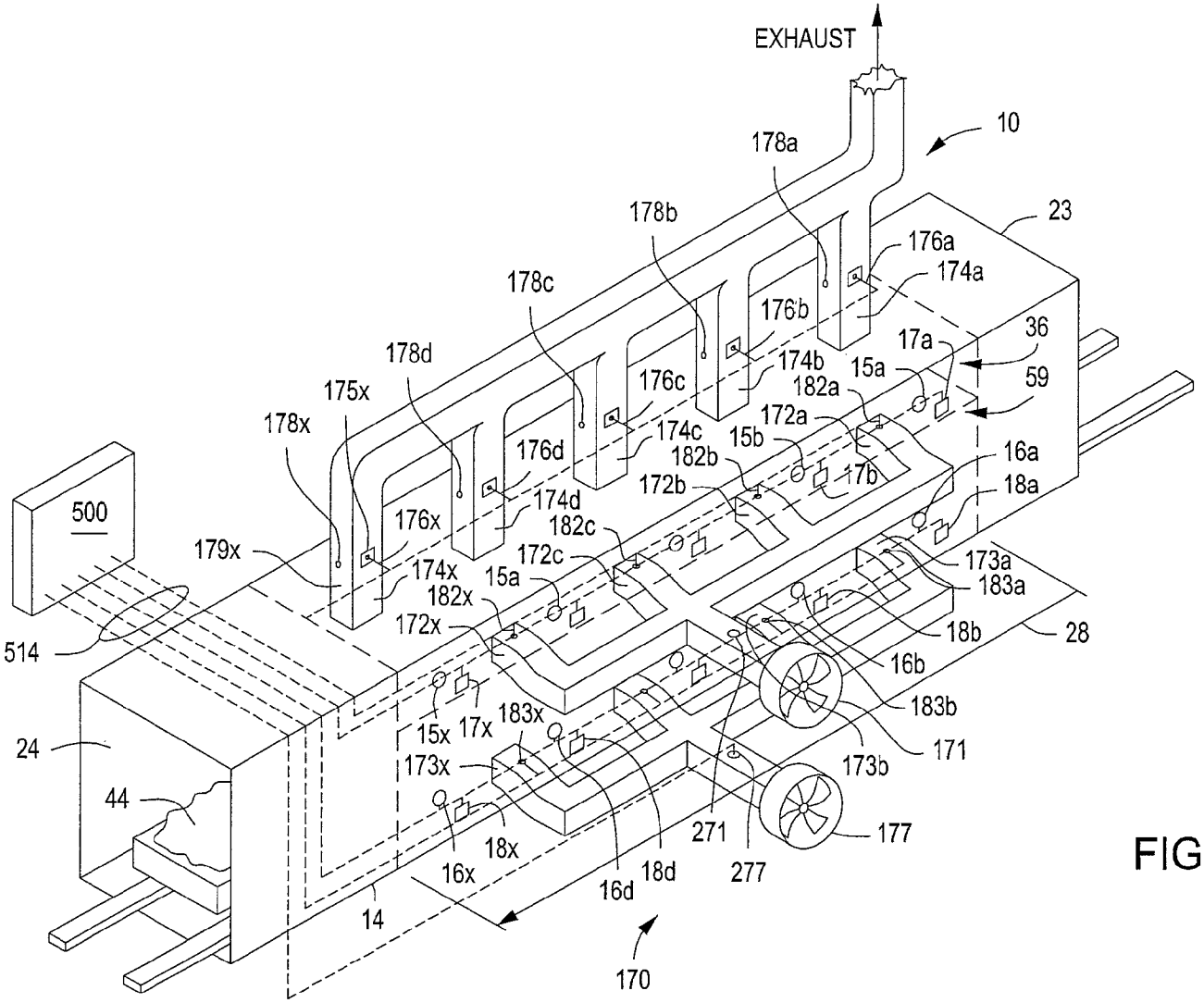
FIG. 1 is a partial perspective view of one embodiment of the inventive air leakage controller system for a tunnel oven.
Figure 2:
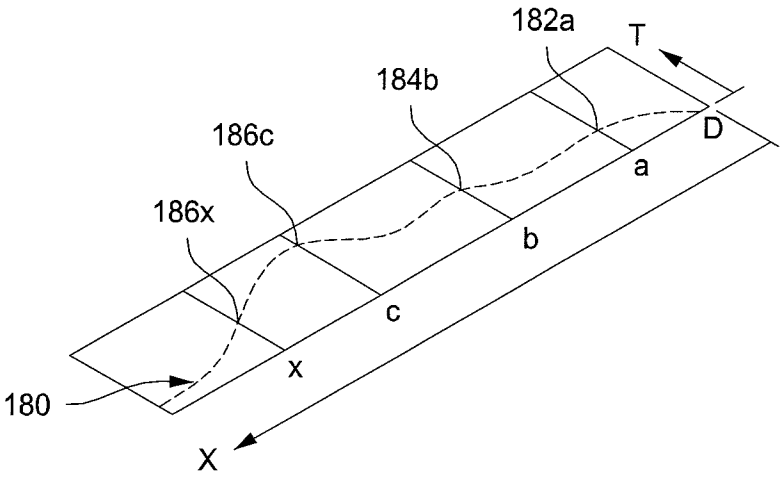
FIG. 2 is a schematic graphical representation of one product heating temperature profile showing relatively high temperature locations and relatively low temperature locations corresponding to locations intended in the tunnel oven for achieving such temperatures.

According to one or more embodiments, FIG. 1 shows a tunnel oven 10 and FIG. 2 shows an example of a graphical presentation of a temperature profile for heating a product 44 in the tunnel oven 10. In one or more embodiments an air leakage control system 170 is connected to and for use with the tunnel oven 10. The inventors have discovered that particular problems may be associated with a tunnel oven of the type that may be an industrial tunnel oven and that may be used for heat processing of products that release combustible materials upon heating or otherwise result in exothermic reaction, thereby giving off more energy than is consumed during at least part of the heating process. For example only, in a heating process where coal or other carbonaceous materials might include trapped hydrocarbon materials that may be volatilized upon heating, released into the oven and then ignited and burned, the amount of heat generated by the exothermic reaction (burning of hydrocarbon) could be significant and could exceed the heat generated by oven heating devices such as gas burners of electrical heating devices. The amount of heat generated by burning can interfere with obtaining a desired or predetermined temperature profile for the product heating process.

Applicants have addressed one or more of the problems that they discovered to exist in the described industrial tunnel oven operating environment, with embodiments of an air leakage control system 170 as described herein. An industrial oven 10 of the type for heat processing of a product 44 that may comprise combustible components or may otherwise undergo an exothermic reaction with oxygen upon heating. Particularly, in the case of hydrocarbon released from a product upon heating, the burning of hydrocarbon requires a source of oxygen. While this has been used by the inventors to benefit for reducing the amount of heat energy that may be required from heaters or burners 15 and 16, it is not always cost effective to maintain a tunnel oven without any extraneous air leakage or without any excess oxygen from burners that may require fuel gas and oxygen input. Thus, when the hydrocarbon is released, and a source of air or oxygen is available the hydrocarbon burns and produces. In a process with a temperature profile having a relatively high temperature part of the process and a relatively low temperature part of the desired temperature profile, it has been found to be useful to introduce air or another oxygen source into the tunnel so that the otherwise unused hydrocarbon can be burned to efficiently supply heat for the process. It is further found by the inventors to be beneficial to avoid entry of an oxidant source, for example, a source of oxygen such as air into the oven at locations along the heating section where the temperature of the process is intended to be relatively low. For purposes of this application the terms relatively high and relatively low are intended to indicate that a temperature of one part of the product heating process (or the temperature at a given location on the temperature profile for the process) is higher or lower relative to another part of the process (or relative to another location on the temperature profile). It has also been found that it is not always possible or at least it is not always cost effective, to prevent all leakage of air into an oven. Leakage may occur, for example, at a product entrance 23 or product exit 24 of the tunnel oven 10. Air leakage may occur along a joint in oven wall, along the floor, along the joint between the wall and the floor 14, at attachment locations for equipment such as burner attachments 15 and 16 or connections for sensors 17 and 18, such as temperature sensors, chemical sensors, and pressure sensors. The entry of air at locations corresponding to the location of relatively low temperatures can result in uncontrolled heating at the location, heating to temperatures above the desired temperature profile at the location, or possible heating to beyond a maximum operating temperature for the oven to maintain the integrity of the oven, and to avoid failure due to meltdown.

According to one or more embodiments air is purposefully injected into the oven at one or more air inlets 172*a-x*, selected for injection according to the proximity to the location in the oven at which a relatively high temperature is desired. Thus, in the example of FIG. 2, where the desired product heating temperature profile has a high temperature at a location (c) and a temperature at one or more other locations (b) and (a) have relatively lower desired temperatures, air may be controllably injected through one or more air inlets 172*c* and/or 173*c*. Air may be introduced or injected directly into a release gas combustion chamber 36 through inlets 172*a-x*, or into the product heating atmosphere 59 through inlets 173*a-x*, so that it is mixed and combusted with the released gas from the product. Air or another oxygen contained gas may be supplied by one or more air supply 171 or 177, that may for example, comprise one or more fans with a volume control 271 and 277, for example by a variable fan speed controller or by restriction valve position. Also in accordance with one or more embodiments, the combustion gas may be exhausted from the oven 10, for example from the combustion chamber 36, through one or more exhaust conduits or chimneys 174*a-x*. To maintain a positive pressure atmosphere in the tunnel oven 10, in accordance with one or more embodiments, exhaust valves or chimney dampers 176*a-x* control the exhaust gas discharge, for example, by controlling the dampener position with a plurality of computer controlled position valves 175*a-x* responsive to one or more of a plurality of pressure sensors 178*a-x* and/or pressure sensors 17 *a-x*, so that a positive pressure is maintained and the volume of flow of gas and air into the oven is relatively greater than the volume of flow out.

It has also been found by the inventors that the injection of air at the location of a relatively high temperature can also be controlled effectively to provide a pressurized atmosphere at the relatively low temperature areas to prevent air from entering through leakage and without causing hydrocarbon burning due to the oxygen content of the injected air. According to one or more embodiments, the amount of air injected is controlled and the rate of exhaust gas discharge is controlled so that oxygen content of the air is depleted and the remaining oxygen depleted air (primarily nitrogen that is inert and not an active oxidant) pressurizes the locations of relatively low desired temperature, effectively without resulting in combustion and exothermic heating in the relatively low temperature locations.

Consider for example the temperature profile 180 of FIG. 2, where the desired or predetermined temperature profile for an example process has a relatively high temperature at 186*c*, and relative low temperatures at 184*b* and 182*a*. According to one example air may be injected into the oven either into inlet 172*c*, 173*c* or both 172*c* and 173 *c*. The exhaust discharge valves 176*a-x* and 176*d* may be adjusted for restricted exhaust flow relative to the volume of air supplied by air supply 171 and/or 177. The hydrocarbon in the oven burns and provides additional heat and raises the temperature to the product (the burners 15*d* and 16*d* may be shut off or operated with minimum fuel consumption). The restricted exhaust flow causes the pressure to increase along the oven and to adjacent locations b and a where relatively lower temperatures are desired. The pressure prevents or at least reduces the influx of ambient air from leakage sources. Because the air is at least partially depleted of oxygen the burning or exothermic reaction at the relatively low temperature locations is not vigorous. Adjustment of the exhaust dampeners 176*b* and 176*a* at corresponding relative low temperature profile locations 182*b* and 182*a*, facilitates mixing of the hydrocarbons into the otherwise inert gas until it can migrate to and combust with air injected at the relatively high temperature profile location 186*c*.

Figure 3:
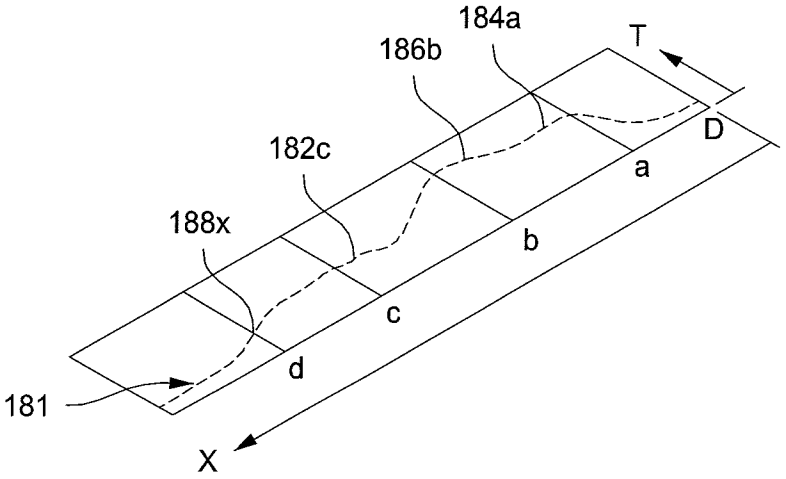
FIG. 3 is a schematic graphical representation of another example of a product heating temperature profile showing two relatively high temperature locations and two relatively low temperature locations corresponding to locations intended in the tunnel oven for achieving such temperatures.

Consider for example the temperature profile 181 of FIG. 3, where the desired or predetermined temperature profile for an example process has two relatively high temperature locations 184*a* and 186*b* and two relatively low temperature locations 182*a* and 188*x* corresponding locations intended in the tunnel oven 10 of FIG. 1 for achieving such temperatures. According to one example, air may be injected into the tunnel oven 10 either into inlet 172*a* and/or 173*a* and also 172*b* and/or 173*b*. The exhaust discharge valves 176*a* 176*b* and 176*c* may be adjusted for restricted exhaust flow relative to the volume of air supplied by air supply 171 and/or 177. The hydrocarbon in the tunnel oven 10 burns and provides additional heat and raises the temperature to the product (the burners 15*a* and 16*a* and also 15*b* and 16*b*, may be shut off or operated with minimum fuel consumption). The restricted exhaust flow causes the pressure to increase along the oven and to adjacent locations c and d where relatively lower temperatures are desired. The pressure prevents or at least reduces the influx of ambient air from leakage sources. Because the air is at least partially depleted of oxygen the burning or exothermic reaction at the relatively low temperature locations is not vigorous. Adjustment of the exhaust dampeners 176*d* and 176*x* at corresponding relatively low temperature profile locations 182*c* and 188*x*, facilitates mixing of the hydrocarbons into the otherwise inert gas until it can migrate to and combust with air injected at the relatively high temperature profile location 186*b*.

According to one or more embodiments air is introduced into a tunnel oven for processing a product with heat wherein the process has a reaction temperature profile with a low temperature at a product entrance and increasing to a first desired higher temperature at a first distance into the tunnel oven, and a desired temperature profile progressing along the length of the tunnel oven, wherein the desired temperature profile includes at least one relatively high temperature and at least one relatively low temperature. An air leakage control system includes an air supply connected to an air injection conduit having an inlet positioned into the tunnel oven at a position corresponding to the temperature profile for the process in the tunnel oven at which the at least one relatively high temperature occurs. A positive pressure is maintained in the tunnel oven to thereby prevent additional air entry into the tunnel oven at other locations, and so that the component of oxygen in the air injected by the air injection conduit is depleted by the exothermic reaction of the product in the tunnel oven at the injection location to facilitate producing the relatively high temperature. Before the injected air flows from the relatively high temperature location to the at least one relatively low temperature location along the temperature profile of the tunnel oven, the air is at least partially depleted of oxygen due to combustion at the location of injection. An air injection control for adjusting the amount of air injected and an exhaust flow restriction act together to maintain a positive pressure in the oven and to provide a volume of air for providing a component of oxygen adequate for maintaining the exothermic reaction at or below the relatively high temperature at the high temperature location and without exceeding the desired relatively low temperature.

According to one or more embodiments, the air injection conduit may have one or more inlets 172*a-x* and/or 173*a-x*, positioned into the tunnel oven 10 at one or more positions. The conduit inlets are controlled by one or more control valves 182*a-x* and/or 183*a-x* so that the air is injected at one or more positions corresponding to one or more positions along the temperature profile in the tunnel oven at which the at least one relatively high temperature is intended for the process and so that a positive pressure is maintained in the tunnel oven at one or more positions along the process temperature profile at which one or more relatively low temperature is intended.

According to one or more embodiments, the air injection conduit may have one or more inlets 172*a-x* and/or 173*a-x*, positioned into the tunnel oven 10 at one or more positions along the temperature profile in the tunnel oven at which the at least one relatively high temperature is to occur, so that the component of oxygen in the air injected by the air injection conduit is involved in an exothermic reaction with the product in the tunnel oven. The oxygen content is thereby at least partially depleted before the injected air flows from the relatively high temperature location to the at least one relatively low temperature location along the temperature profile of the tunnel oven.

According to one or more embodiments, an air injection pressure control is provided for adjusting the amount of air injected to maintain the positive pressure and to provide a volume of air for providing a component of oxygen adequate for maintaining the exothermic reaction at or below the relatively high temperature without exceeding the desired relatively low temperature. The pressure control may comprise an adjustable speed fan motor for providing a pressurized air supply and an exhaust valve control for adjusting the volume of exhaust gas discharged from the oven.

Figure 4:
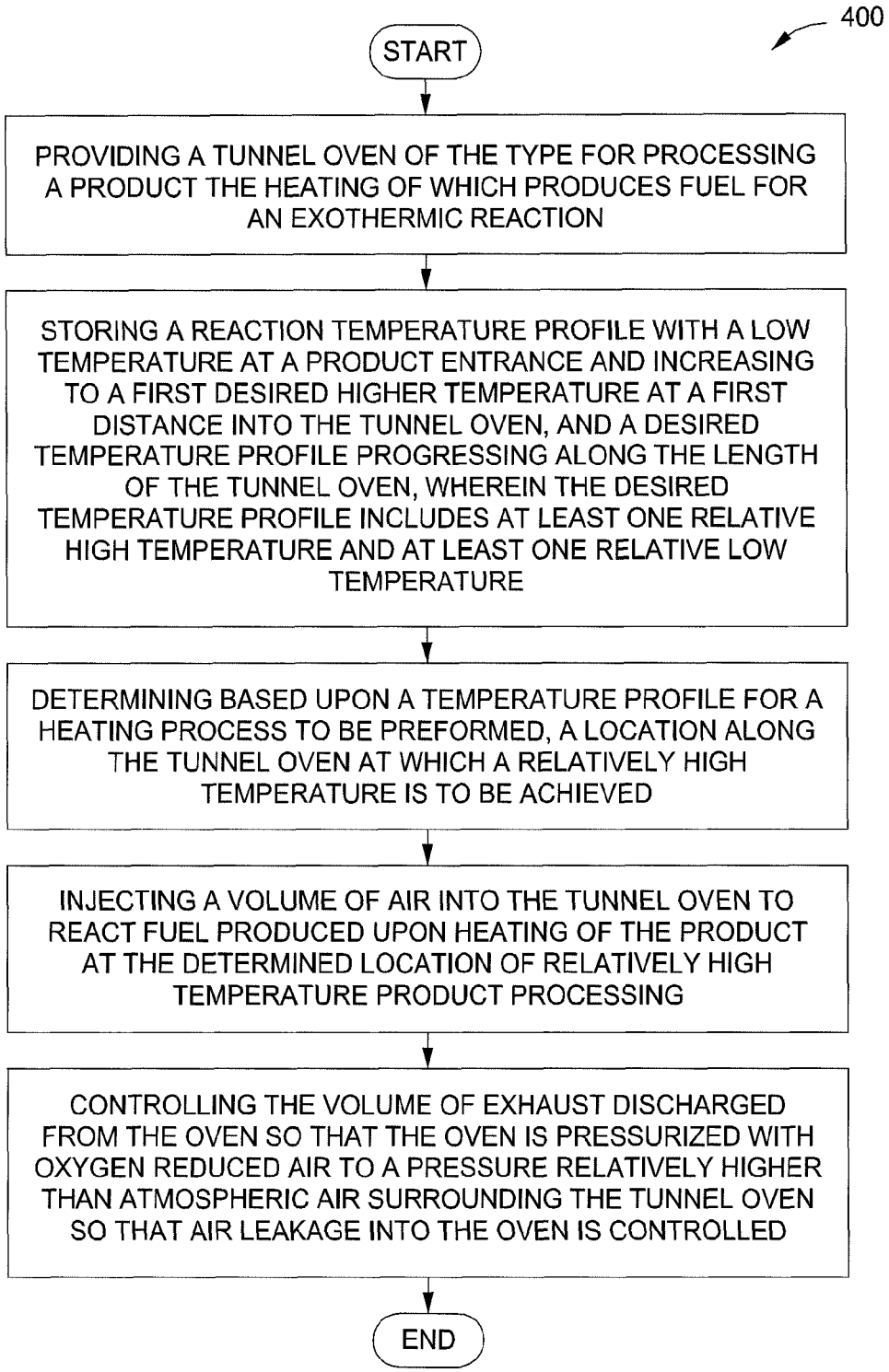
FIG. 4 is a block diagram of a method for air leakage control in a tunnel oven.

According to one or more embodiments as shown in FIG. 4, a method for air leakage control 400 is provided for a tunnel oven of the type for processing a product the heating of which produces fuel for an exothermic reaction and having a reaction temperature profile with a low temperature at a product entrance and increasing to a first desired higher temperature at a first distance into the tunnel oven, and a desired temperature profile progressing along the length of the tunnel oven, wherein the desired temperature profile includes at least one relatively high temperature and at least one relatively low temperature. The method may include the steps of determining based upon a temperature profile for a heating process to be performed, a location along the tunnel oven at which a relatively high temperature is to be achieved. The method includes injecting a volume of air into the tunnel oven to react fuel produced upon heating of the product at the determined location of relatively high temperature product processing and controlling the volume of exhaust discharged from the oven so that the oven is pressurized with oxygen reduced air to a pressure relatively higher than atmospheric air surrounding the tunnel oven so that air leakage into the oven is controlled.

According to one or more embodiments, one or more of the air supply fan speed or restrictor position is computer controlled, the inlet valves 182*a-x* and/or 183*a-x* are computer controlled, the exhaust valves 176*a-x* are computer controlled. According to one or more embodiments pressure sensors and temperature sensors and/or chemical sensors are communicatively connected to the computer control for providing sensor information to be compared to a stored temperature profile for a predetermined heating process so that the air injection and exhaust discharge are controlled and adjusted to move the temperature of the process along the tunnel oven toward the stored desired or pre-determined process for the product.

Figure 5:
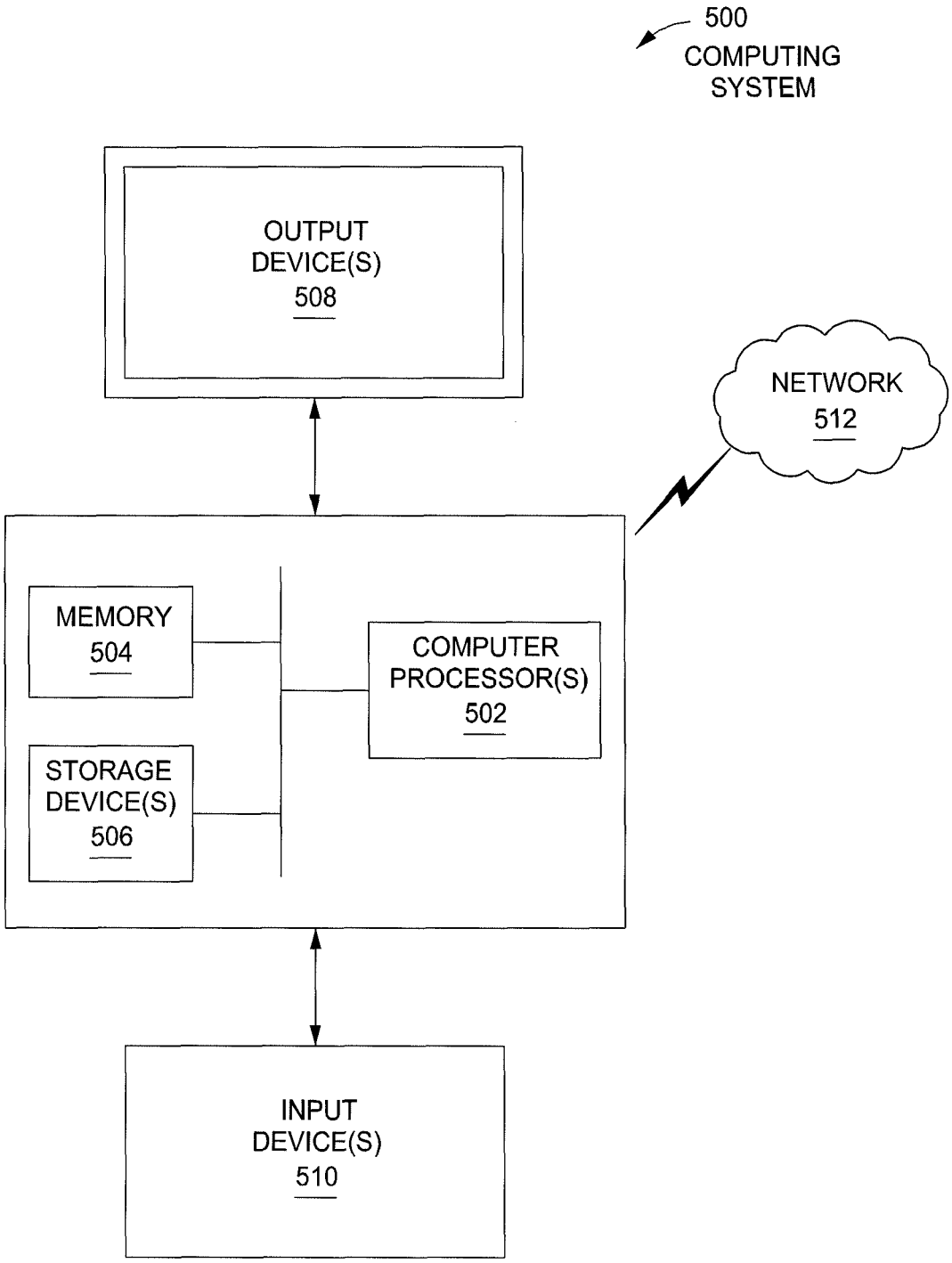
FIG. 5 is a block diagram of a computer system for controlling the system and/or the process described.

Embodiments of the invention may be implemented on virtually any type of computing system regardless of the platform being used. For example, the computing system may be one or more mobile devices (e.g., laptop computer, smart phone, personal digital assistant, tablet computer, or other mobile device), desktop computers, servers, blades in a server chassis, or any other type of computing device or devices that includes at least the minimum processing power, memory, and input and output device(s) to perform one or more embodiments of the invention. For example, as shown in FIG. 5, the computing system (500) may include one or more computer processor(s) (502), associated memory (504) (e.g., random access memory (RAM), cache memory, flash memory, etc.), one or more storage device(s) (506) (e.g., a hard disk, an optical drive such as a compact disk (CD) drive or digital versatile disk (DVD) drive, a flash memory stick, etc.), and numerous other elements and functionalities. The computer processor(s) (502) may be an integrated circuit for processing instructions. For example, the computer processor(s) may be one or more cores, or micro-cores of a processor. The computing system (500) may also include one or more input device(s) (510), such as a touchscreen, keyboard, mouse, microphone, touchpad, electronic pen, or any other type of input device. Further, the computing system (500) may include one or more output device(s) (508), such as a screen (e.g., a liquid crystal display (LCD), a plasma display, touchscreen, cathode ray tube (CRT) monitor, projector, or other display device), a printer, external storage, or any other output device. One or more of the output device(s) may be the same or different from the input device(s). The computing system (500) may be connected to a network (512) (e.g., a local area network (LAN), a wide area network (WAN) such as the Internet, mobile network, or any other type of network) via a network interface connection (not shown). The input and output device(s) may be locally or remotely (e.g., via the network (512)) connected to the computer processor(s) (502), memory (504), and storage device(s) (506). Many different types of computing systems exist, and the aforementioned input and output device(s) may take other forms.

Software instructions in the form of computer readable program code to perform embodiments of the invention may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s), is configured to perform embodiments of the invention.

Further, one or more elements of the aforementioned computing system (500) may be located at a remote location and connected to the other elements over a network (512). Further, embodiments of the invention may be implemented on a distributed system having a plurality of nodes, where each portion of the invention may be located on a different node within the distributed system. In one embodiment of the invention, the node corresponds to a distinct computing device. Alternatively, the node may correspond to a computer processor with associated physical memory. The node may alternatively correspond to a computer processor or microcore of a computer processor with shared memory and/or resources.

While the invention has been described with respect to a limited number of embodiments, and the discussion has focused on a limited number of embodiments of an air leakage controller, method controlling air leakage along a tunnel oven and system for controlling air leakage along a tunnel oven, those skilled in the art, having benefit of this disclosure, will appreciate that other embodiments, arrangements and combinations of inventive features can be devised according to the disclosure that do not depart from the scope of the invention as disclosed herein. Accordingly, the scope of the invention should be limited only by the broadest interpretation of the attached claims.

What is claimed is:

1. An air leakage control system for a tunnel oven of the type for processing a product fueled, exothermic reaction having a reaction temperature profile with a relatively low temperature at a first distance into the tunnel oven and increasing to a relatively higher temperature at another location at a second distance from the tunnel entrance, and a desired temperature profile progressing along the length of the tunnel oven, wherein the desired temperature profile includes at least one relatively high temperature and at least one relatively low temperature, the air leakage controller comprising:

an air injection conduit having an inlet positioned in the tunnel oven to inject air at a position corresponding to a position along the temperature profile in the tunnel oven at which the at least one relatively high temperature occurs, so that a positive pressure is produced by the injected air and maintained in the tunnel oven to thereby prevent additional air entry into the tunnel oven at other locations, and so that the component of oxygen in the air injected by the air injection conduit is depleted by the exothermic reaction of the product in the tunnel oven before the injected air flows from the relatively high temperature position to at least one position at which the relatively low temperature occurs along the temperature profile of the tunnel oven; and an air injection pressure control for adjusting the amount of air injected to maintain the positive pressure and to provide a volume of air for providing a component of oxygen adequate for maintaining the exothermic reaction at or below the relatively high temperature without exceeding the desired relatively low temperature.

2. The air leakage control system for a tunnel oven of claim 1, comprising:

a. an exhaust gas discharge positioned in the tunnel oven at the at least one position corresponding to the temperature profile in the tunnel oven at which the at least one relatively high temperature occurs, and b. a control for the exhaust gas discharge to maintain a positive pressure in the tunnel oven at the relatively high temperature position so that a positive pressure is maintained for combustion in an exothermic reaction with volatile components of the product so that the air is at least partially depleted of oxygen and the depleted oxygen air pressurizes the tunnel oven to reduce leakage of ambient air into the tunnel oven.

3. The air leakage control system for a tunnel oven of claim 1, comprising:

a. an plurality of exhaust gas discharge chimneys positioned in the tunnel oven at a position corresponding to a plurality of positions along the temperature profile in the tunnel oven, and b. a plurality of control dampeners, one or more in each of the plurality of exhaust discharge chimneys, for selectively and adjustably opening or closing one or more of the exhaust gas discharge chimneys to maintain a positive pressure in the tunnel oven at the at least one relatively high temperature position so that a positive pressure is maintained for combustion in an exothermic reaction with volatile components of the product so that the air is at least partially depleted of oxygen and the depleted oxygen air pressurizes the tunnel oven to reduce leakage of ambient air into the tunnel oven.

4. The air leakage control system for a tunnel oven of claim 1, wherein the air injection conduit comprises a plurality of inlets positioned at spaced apart locations along the tunnel oven so that one or more of the inlets may be controlled to inject air into the oven at a relatively high temperature location depending upon a temperature profile for one or more alternative heating processes.

5. The air leakage controller for a tunnel oven of claim 1, wherein the tunnel oven comprises a combustion chamber above a heating section and wherein the air injection conduit comprises a plurality of inlets into the combustion chamber positioned at spaced apart locations along the tunnel oven and controllable valves for adjustably opening and closing the one or more of the inlets so that one or more of the inlets may be controlled to inject air into the combustion chamber of the tunnel oven at a relatively high temperature location depending upon a temperature profile for one or more alternative heating processes.

6. The air leakage controller for a tunnel oven of claim 2, wherein the tunnel oven comprises a combustion chamber above a product heating section and wherein the air injection conduit comprises a plurality of inlets into the combustion chamber positioned at spaced apart locations along the tunnel oven into the combustion chamber and into the product heating region and controllable valves for adjustably opening and closing the one or more of the inlets so that one or more of the inlets may be controlled to inject air into the combustion chamber of the tunnel oven and into the product heating region at a relatively high temperature location depending upon a temperature profile for one or more alternative heating processes.

7. The air leakage controller for a tunnel oven of claim 1, the air injection pressure control for adjusting the amount of air injected to maintain the positive pressure and to provide a volume of air for providing a component of oxygen adequate for maintaining the exothermic reaction at or below the relatively high temperature without exceeding the desired relatively low temperature comprising:

a variable speed fan coupled with the air injection conduit for providing a variable volume of air into the tunnel oven to maintain a positive pressure and reduce ambient air leakage into the tunnel oven.

8. The air leakage control system for a tunnel oven of claim 5, the air injection pressure control for adjusting the amount of air injected to maintain the positive pressure and to provide a volume of air for providing a component of oxygen adequate for maintaining the exothermic reaction at or below the relatively high temperature without exceeding the desired relatively low temperature comprising:

a. a first air supply for the conduits into the combustion chamber; and b. a second air supply for the conduits into the product heating region of the tunnel oven.

9. A method for air leakage control is provided for a tunnel oven comprising:

processing a product the heating of which produces fuel for an exothermic reaction and having a reaction temperature profile with a low temperature at a product entrance and increasing to a first desired higher temperature at a first distance into the tunnel oven, and a desired temperature profile progressing along the length of the tunnel oven, wherein the desired temperature profile includes at least one relatively high temperature and at least one relatively low temperature;

determining, based upon a temperature profile for a heating process to be performed, a location along the tunnel oven at which a relatively high temperature is to be achieved;

injecting a volume of air into the tunnel oven to react fuel produced upon heating of the product at the determined location of relatively high temperature product processing; and controlling the volume of exhaust discharged from the oven so that the oven is pressurized with oxygen reduced air to a pressure relatively higher than atmospheric air surrounding the tunnel oven so that air leakage into the oven is reduced.

10. The method for air leakage control of claim 9, wherein the steps are performed by a computer communicatively coupled to the leakage control system.

* * * * *